US008230708B2

(12) United States Patent
Widén

(10) Patent No.: US 8,230,708 B2
(45) Date of Patent: Jul. 31, 2012

(54) CYLINDER LOCK AND KEY COMBINATION WITH A BLOCKING ELEMENT IN THE LOCK

(75) Inventor: Bo Widén, Torshilla (SE)

(73) Assignee: Winloc AG, Zug (CH)

( * ) Notice: Subject to any disclaimer, the term of this patent is extended or adjusted under 35 U.S.C. 154(b) by 47 days.

(21) Appl. No.: 12/388,069

(22) Filed: Feb. 18, 2009

(65) Prior Publication Data

US 2010/0206027 A1 Aug. 19, 2010

(51) Int. Cl.
*E05B 19/06* (2006.01)
*E05B 27/00* (2006.01)

(52) U.S. Cl. ..... 70/409; 70/358; 70/406; 70/493; 70/495

(58) Field of Classification Search ..... 70/358, 70/367, 347, 356, 378, 405–407, 409, 419–421, 70/453, 493–496
See application file for complete search history.

(56) References Cited

U.S. PATENT DOCUMENTS

| | | | | | |
|---|---|---|---|---|---|
| 4,356,713 | A * | 11/1982 | Widen | | 70/495 |
| 4,393,673 | A * | 7/1983 | Widen | | 70/358 |
| D274,302 | S * | 6/1984 | Widen | | D8/347 |
| 4,453,432 | A * | 6/1984 | Widen | | 76/110 |
| 4,756,177 | A * | 7/1988 | Widen | | 70/493 |
| 4,815,307 | A * | 3/1989 | Widen | | 70/493 |
| 5,067,335 | A * | 11/1991 | Widen | | 70/495 |
| 5,421,179 | A * | 6/1995 | Bergstrom | | 70/369 |
| 5,517,840 | A * | 5/1996 | Haggstrom | | 70/495 |
| 5,582,050 | A * | 12/1996 | Haggstrom | | 70/495 |
| 5,640,865 | A * | 6/1997 | Widen | | 70/495 |
| 5,715,717 | A * | 2/1998 | Widen | | 70/493 |
| 5,809,816 | A * | 9/1998 | Widen | | 70/493 |
| 5,845,525 | A * | 12/1998 | Widen | | 70/493 |
| 5,964,112 | A * | 10/1999 | Stefanescu | | 70/493 |
| 6,134,929 | A * | 10/2000 | Widen | | 70/493 |
| 6,851,292 | B2 * | 2/2005 | Kruhn | | 70/409 |
| 7,159,424 | B2 * | 1/2007 | Widen | | 70/409 |
| 7,370,502 | B2 * | 5/2008 | Widen | | 70/493 |
| 7,487,653 | B2 * | 2/2009 | Widen | | 70/409 |
| 7,621,163 | B2 * | 11/2009 | Widen | | 70/493 |
| 7,665,336 | B2 * | 2/2010 | Widen | | 70/409 |
| 7,665,337 | B1 * | 2/2010 | Widen | | 70/409 |
| 7,810,364 | B2 * | 10/2010 | Widen | | 70/409 |

FOREIGN PATENT DOCUMENTS

EP 237172 A2 * 9/1987

* cited by examiner

*Primary Examiner* — Carlos Lugo
*Assistant Examiner* — Alyson M Merlino
(74) *Attorney, Agent, or Firm* — Birch, Stewart, Kolasch & Birch, LLP

(57) ABSTRACT

A cylinder lock and key combination is disclosed. The lock comprises a housing (30) having a cylindrical bore and a cylindrical key plug (33) being rotatably journalled in said cylindrical bore. The key plug has a longitudinal, profiled keyway (34) and means (1, 2) for locking the key plug against rotation in the cylindrical bore unless a correctly cut key is fully inserted into the keyway. The key blade (60) has a cross-sectional profile fitting into said keyway, and a profile groove (61) extending longitudinally along the key blade. The lock comprises a blocking mechanism with at least one blocking element (20), which is movable from a first blocking position, in which first projecting portion (21) of the cross-sectional profile of the blocking element extends outside the cross-sectional contour of said profile rib, into a second blocking position, in which a second projecting portion (22) extends outside the contour of the rib and is accommodated in a recess (70) in the key blade. Hereby a correctly cut key can be fully inserted.

20 Claims, 7 Drawing Sheets

CYLINDER LOCK AND KEY COMBINATION WITH A BLOCKING ELEMENT IN THE LOCK

FIELD AND BACKGROUND OF THE INVENTION

An embodiment of the present invention is directed to a cylinder lock and key combination, wherein said cylinder lock comprises:

a housing having a cylindrical bore, a cylindrical key plug being rotatably journalled in said cylindrical bore, said key plug having a longitudinal, profiled keyway and means for locking the key plug against rotation in the cylindrical bore unless a correctly cut key blade is fully inserted into the keyway, said keyway being oriented along a central plane and having a profiled cross-section being partly defined by a profile rib extending longitudinally along said key plug and having a predetermined cross-sectional contour along at least a part of its length, and wherein said key comprises a correctly cut key blade having:

a cross-sectional profile fitting into said keyway, and a profile groove formed by a lower side wall and an upper side wall and extending longitudinally along the correctly cut key blade, said profile groove having a cross-sectional profile configured to accommodate said profile rib of the keyway when the correctly cut key blade is being inserted into the lock, wherein:

said lock comprises a blocking mechanism with at least one blocking element reaching into said keyway in the vicinity of said profile rib, said profile rib being provided with at least one longitudinally confined cut-out portion accommodating said at least one blocking element and each said at least one blocking element forming a movable portion of said profile rib, said at least one blocking element is movable from a first blocking position, in which a first projecting portion of a cross-sectional profile of the at least one blocking element extends outside and below the cross-sectional contour of said profile rib, into a second blocking position, in which a different, second projecting portion of said at least one blocking element extends outside and above the cross-sectional contour of said profile rib and is accommodated by at least one local recess formed in the upper side wall of the profile groove of the correctly cut key blade, one of said first projecting portion and said second projecting portion of the at least one blocking element always extending outside the contour of the profile rib, seen in a vertical direction, the insertion of the correctly cut key blade causes the movement of said at least one blocking element from said first blocking position into said second blocking position, said first and second projecting portions of said at least one blocking element are non-symmetrical in shape;

wherein a vertical dimension of an outer portion of said profile groove between said lower side wall and said upper side wall is smaller than a vertical dimension of said at least one blocking element except at said at least one local recess where a vertical dimension of said outer portion is larger than the vertical dimension of said at least one blocking element, said vertical dimension of said outer portion of said at least one local recess extending between non-symmetrical and non-parallel upper and lower side walls thereof;

said upper and lower side walls of said outer portion of said at least one local recess being adapted in shape so as to accommodate said non-symmetrical first and second projecting portions of said at least one blocking element; and said profile groove, with its at least one local recess, being configured to enable said at least one blocking element to perform an elevational movement to said second blocking position so as to be accommodated in said at least one local recess, when the correctly cut key blade is being inserted into said key way of the key plug but blocks the full insertion of any other key blade not being provided with said at least one local recess.

Such lock and key combinations are generally known, e.g. from the U.S. Pat. No. 5,715,717 (Widén). The profile groove or grooves in the key, and the corresponding profile ribs in the keyway of the lock, will provide great possibilities to vary the cross-sectional profile of the key, which is a great advantage.

OBJECT OF THE INVENTION

Against this background, the object of the invention is to provide a lock and key combination which provides for an even greater number of profile varieties.

SUMMARY OF THE INVENTION

According to the present invention, this object is achieved by providing the lock with a blocking mechanism having at least one movable blocking element, serving as a movable keyway portion and reaching into the keyway in the vicinity of the profile rib, said blocking element being movable from a first blocking position, in which a first projecting portion of the cross-sectional profile of the blocking element extends outside the cross-sectional contour of said profile rib, into a second blocking position, in which a different, second projecting portion of said blocking element extends outside the cross-sectional contour of the profile rib and is accommodated by a local recess of a correctly configured key blade.

The insertion of such a key blade will bring about the movement of the blocking element from said first position into said second position. Thus, the key blade will make contact with the first, projecting portion of the blocking element and thereby move it into the second position, in which the second, projecting portion of the blocking element extends outside the cross-sectional contour of the profile rib in the keyway. In this way, the effective profile of the keyway will be changed when a key blade is being inserted into the keyway.

Moreover, the first and second projecting portions of the blocking element are non-symmetrical in shape. Only one of these blocking element portions is visible when there is no key inserted into the key way, so when the keyway is free for inspection from the outside, the second projecting portion of the blocking element is concealed within a cut-out portion of the profile rib. Since it has a non-symmetrical configuration in relation to the visible, first projecting portion of the movable blocking element, it is also impossible to predict what shape it has. Accordingly, the effective, local profile of the keyway is virtually impossible to determine, and it will therefore be difficult to make a key that will open the lock on the basis of only inspecting the keyway.

In essence, the blocking element can be regarded as a movable keyway portion, the shape of which is unknown.

The movable blocking element or keyway portion may be configured in many different ways. It may have a part with a cross-section which, apart from the second projecting portion, has a cross-section corresponding substantially to only a part of the cross-sectional area of the profile rib, or it may have a cross-section corresponding entirely to the cross-sectional contour of the profile rib. In the latter case, of course, the blocking element will match and entirely fill out the profile groove of the key blade, whereas the projecting, second portion of the blocking element needs to be accommodated by a local recess in the key blade. Otherwise, the second portion of the blocking element will stop further insertion of the key blade into the keyway.

The second, projecting portion of the blocking element may have a slanted surface portion, which faces obliquely away from the associated side wall of the keyway, and the profile rib may have a corresponding, inclined surface portion also facing obliquely away from the associated side wall of the keyway. Preferably, the inclinational angle relative to a plane perpendicular to said side wall of the keyway, is about the same as the inclinational angle of the inclined surface portion of the base portion of the profile rib.

With such a structure, the second projecting portion of the blocking element may extend upwards with a tapering end, even to a region where the keyway (and thus also the key blade) has a transition between a relatively wide lower portion and a relatively narrow upper portion, and even so leave a sufficient material region for the key blade to have sufficient strength in the corresponding transition region.

The slanted surface portion of the blocking element will provide a relatively large travel distance for the blocking element and will thus secure a maximum blocking effect, i.e. a good capability of preventing an incorrectly cut key blade from being fully inserted into the key blade.

In an embodiment, the blocking element corresponds to the cross-sectional area of a base part of the profile rib only.

In a further embodiment, the blocking element extends through a side opening in a side wall of the keyway from a body which is movably guided in a side cavity in the key plug, the body and the blocking element forming parts of a blocking mechanism of the lock. In this way, the blocking element can be properly guided for a linear movement elevationally while making contact with a key being inserted into the keyway. Most conveniently, the body and the associated cavity are substantially cylindrical.

The blocking element, preferably by way of the guided body in the cavity, may cooperate with a means for locking the key plug against rotation, e.g. by means of a side bar or by an end portion of the body extending past a circumferential surface of the key plug so as to register with a recess or hole in the lock housing, whereby the key plug will be firmly locked.

Such a locking of the key plug against rotation may be supplemented by a conventional locking mechanism with lower and upper locking pins, located above the keyway and being guided in associated holes in the key plug and the housing, respectively.

Further features of the invention will appear from the dependent claims and the detailed disclosure of some preferred embodiments which will be explained below with reference to the appended drawings.

SHORT DESCRIPTION OF THE DRAWINGS

FIG. 1*a* shows, in a side view a cylinder lock according to the present invention, with a key blade inserted therein;

FIG. 1*b* shows the cylinder lock and key combination of FIG. 1*a* in a perspective view;

FIG. 1*c* shows the lock and key combination of FIG. 1*a* in a perspective, exploded view, illustrating a locking mechanism above the keyway of the lock;

FIG. 1*d* shows a cross-section along the line Id-Id in FIG. 1*a* also illustrating a blocking element;

FIG. 1*e* shows a cross-section similar to the one in FIG. 1*d*, without an inserted key;

FIG. 2 shows, in a side view, a lock and key combination with a modified blocking element, FIG. 3 shows a cross-section along the line III-III in FIG. 2;

FIG. 4*a* shows a cross-section along the line IVa-Iva in FIG. 2;

FIG. 4*b* shows a part of FIG. 4*a* at a larger scale;

FIG. 5*a*, 5*b*, 5*c* show, in views similar to FIGS. 1*a*, 1*d* and 1*e* (without a key), an embodiment having a blocking element also serving to lock the key plug against rotation;

FIGS. 6*a*, 6*b*, 6*c* show the embodiment of FIGS. 5*a*, 5*b*, 5*c* upon insertion of a key blade into the lock;

FIGS. 7*a*, 7*b* show schematically in perspective views how the key blade interacts with the blocking element of the lock (FIG. 7*b* at a larger scale);

FIGS. 8*a* and 8*b* show the key blade of FIGS. 7*a*, 7*b* in a side view (FIG. 8*b* at a larger scale), FIGS. 9*a* and 9*b* show, in views corresponding to FIGS. 7*a* and 7*b*, a key blade and an associated blocking element of the kind also serving to lock the key plug against rotation;

DETAILED DESCRIPTION OF PREFERRED EMBODIMENTS

In FIGS. 1*a*, 1*b*, 1*c*, 1*d*, 1*e* there is shown a cylinder look and key combination having conventional upper and lower tumbler pins 1, 2 in a linear row (FIG. 1*c*) cooperating with an upper edge of the inserted key blade, the upper edge having a corresponding number of recess cuts 11, 12, 13, 14, 15, 16 at various levels. Deep inside the keyway of the lock, not very far from the tip of the inserted key blade, there is a blocking element 20, which is movable elevationally (up and down) at the side of the keyway.

Figure 1A:
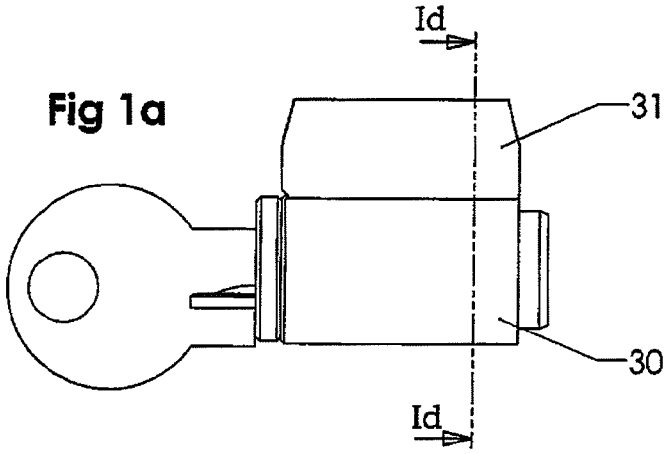
Figure 1B:
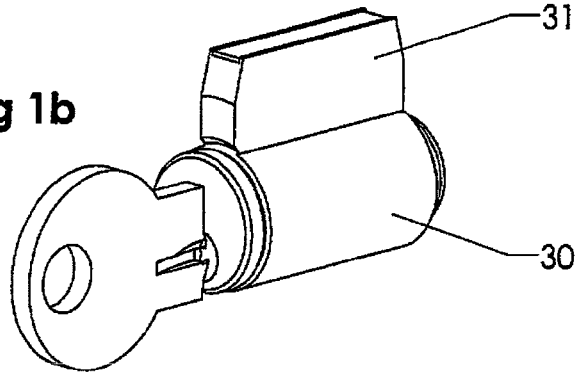
Figure 1C:
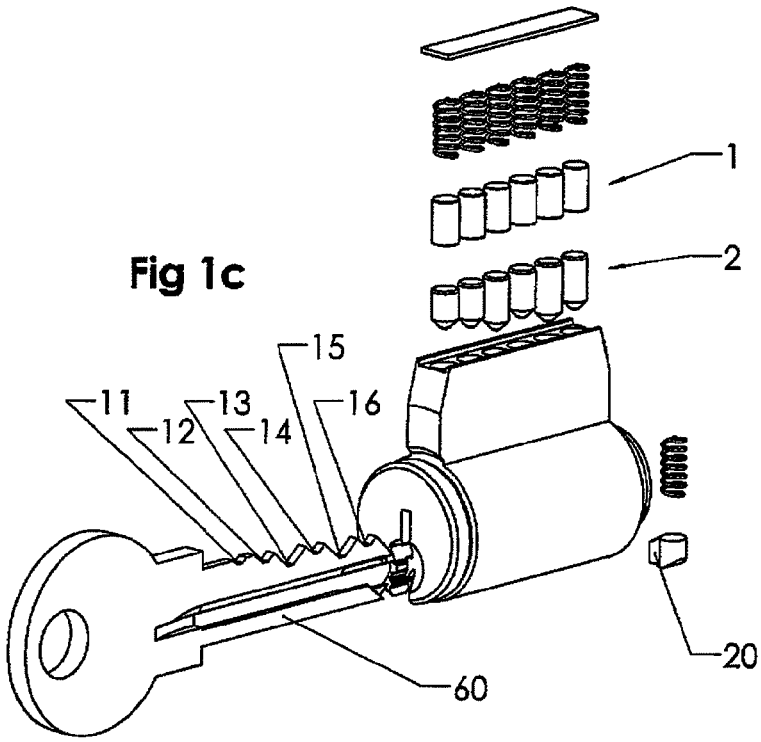
Figure 1D:
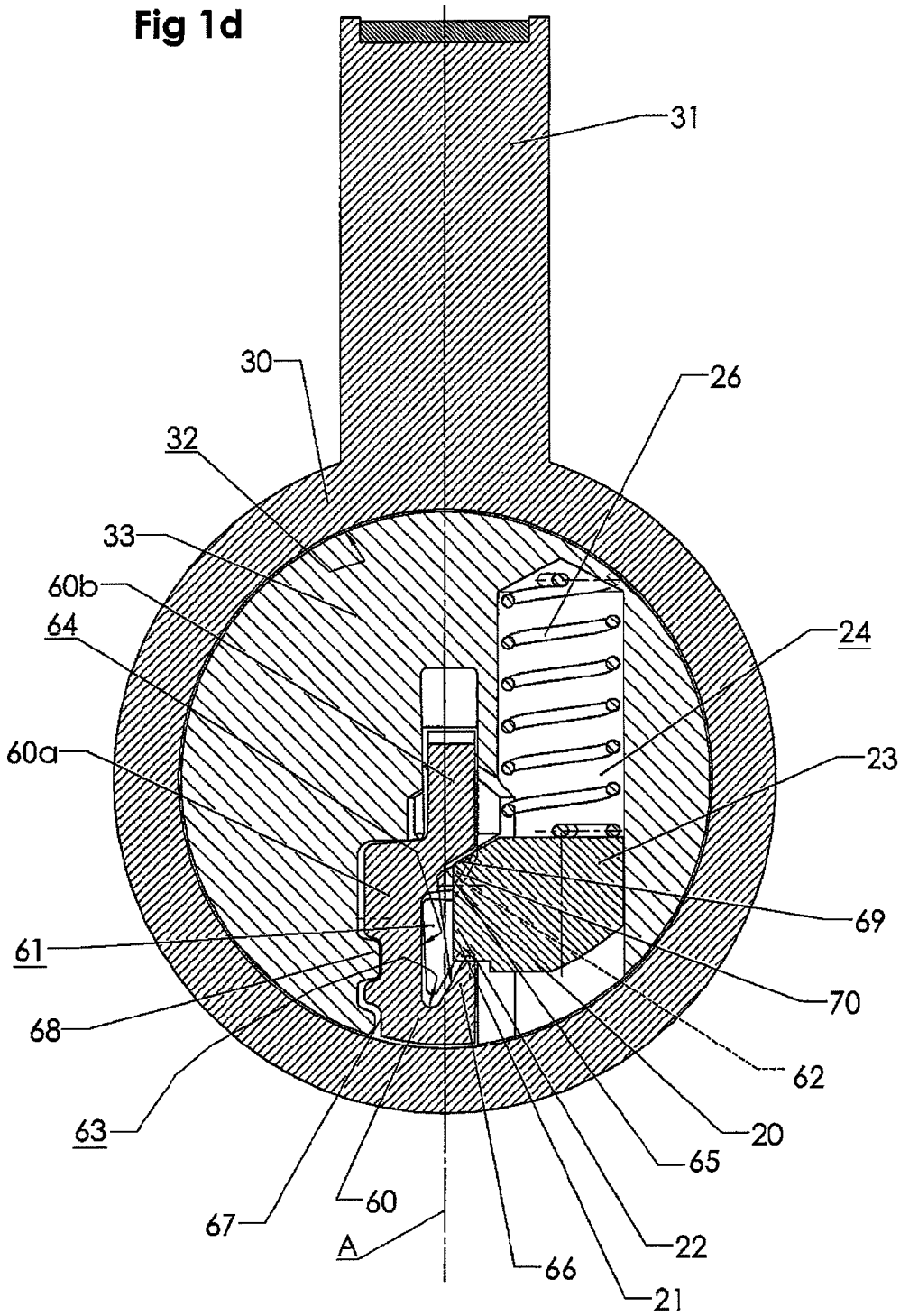
Figure 1E:
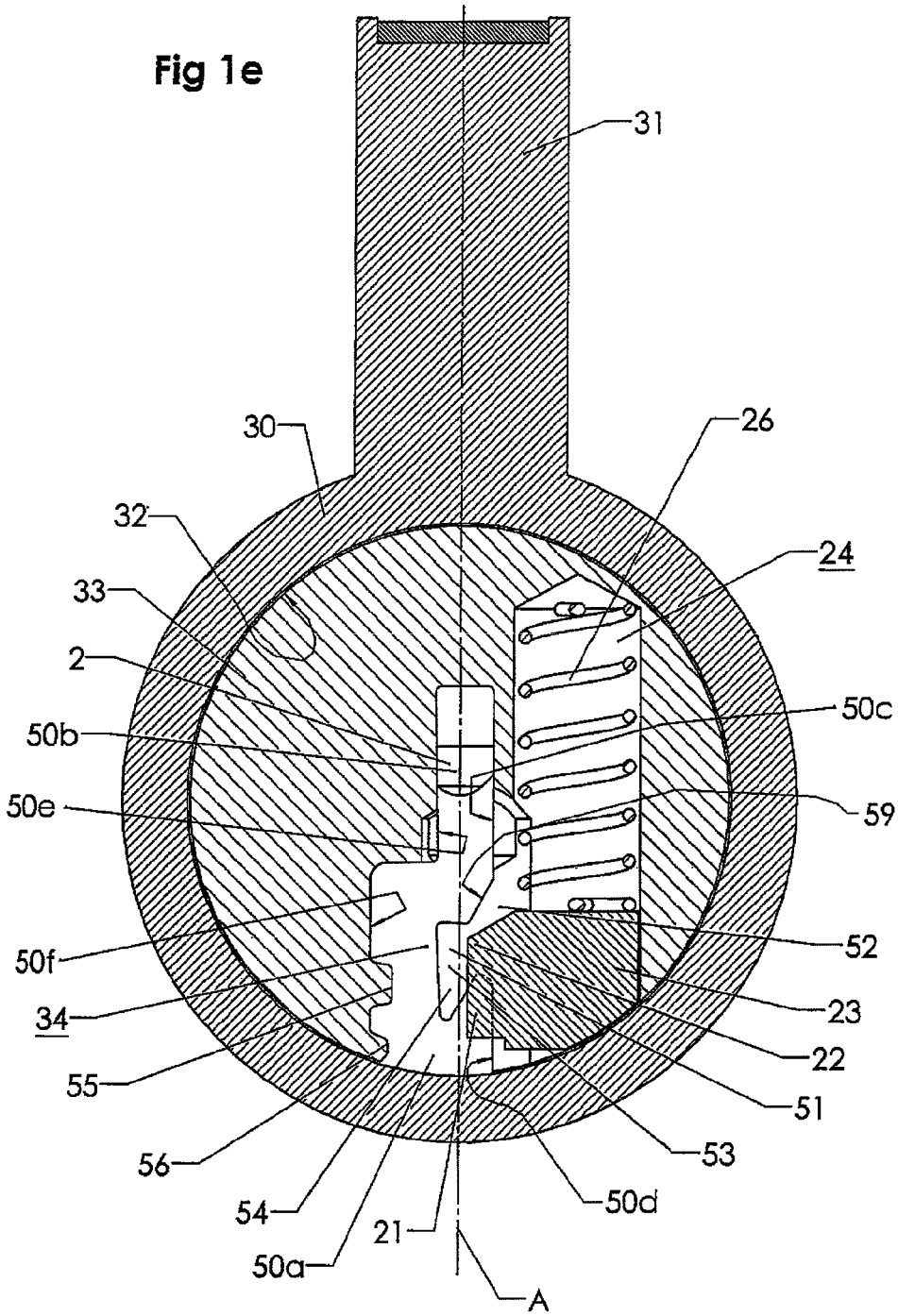

The blocking element, and its interaction with the inserted key blade, will be better understood from FIGS. 1*d* and 1*e*. Here, the cylindrical housing of the lock is denoted 30, heaving an upright housing part 31 accommodating the upper locking pins 1,2 mentioned above and a cylindrical bore 32, in which a cylindrical key plug 33 is rotatably journalled.

The key plug 33 has a central keyway 34 extending longitudinally along the axis of the cylindrical bore 32 and a central plane A extending through the cylindrical axis and the upper housing portion 31. In a longitudinal row in this plane A, there are a number of cylindrical holes (not visible in FIG. 1*d*) each accommodating one of the lower locking pins 2. In FIGs. 1*d* and 1*e*, the profile of the keyway 34 (FIG. 1*e*) and the corresponding key blade 60 (FIG. 1*d*) are clearly visible. The keyway 34 is oriented along the central plane A. It has a lower, rather wide portion 50*a*, and an upper, relatively narrow portion 50*b*. The upper and lower portions of the keyway have side walls 50*c* and 50*d* lying in a common plane in parallel to the central plane A (to the right thereof in FIG. 3). At the other lateral side, the upper keyway portion 50*b* has a side wall 50*e*, whereas the lower part of the keyway has a side wall 50*f*, the latter being located further away from the central plane A than the upper side wall 50*e*.

On the right hand side of the keyway, there is a longitudinal, profiled rib 51 extending along the key plug. The profile rib 53 has a base portion 52 (concealed by the blocking element 20 in FIG. 1*d*) and an end portion 53 provided with a downwardly directed tongue 54.

On the left hand side, the keyway has two longitudinal ribs 55 and 56 at the lower portion of the keyway.

The key blade 60 (FIG. 1*d*) has a profile shape which is substantially supplementary to the keyway 34. Accordingly, the key 60 has a lower base portion 60*a*, which is relatively wide, and an upper portion 60*b*, which is relatively narrow.

At the right hand side (as seen in FIG. 1*d*) the key blade has a longitudinally extending groove 61 with an outer portion 62, and an inner, undercut portion 63. The profile groove 61 has a bottom wall 64 and an opposite side wall 65, which is inclined and faces the bottom wall 64 and also forms the inside wall of a ridge 66 extending along the key blade 60.

As will be evident from FIG. 1*d*, the profile groove 61 accommodates the longitudinally extending profile rib 51, including the downwardly directed tongue 54 in the undercut portion of the groove 61.

On the left hand side, the key blade 60 has two longitudinal grooves 67 and 68 corresponding to the profile ribs 55, 54.

Figure 3:
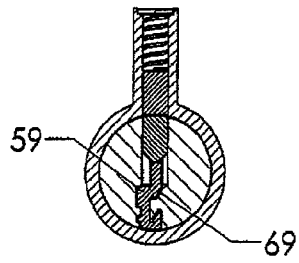
Figure 2:
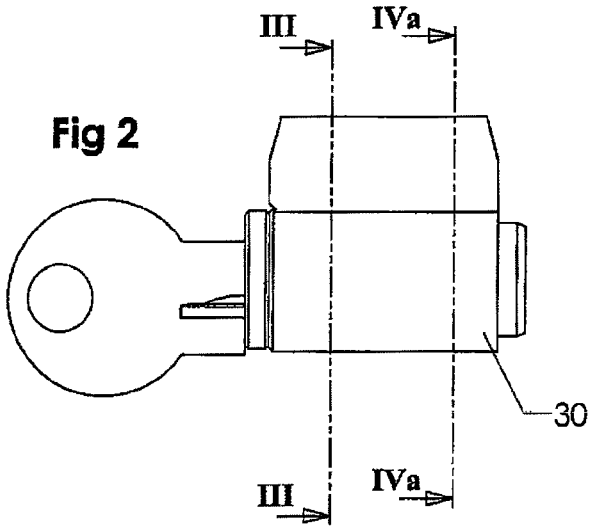
Figure 4A:
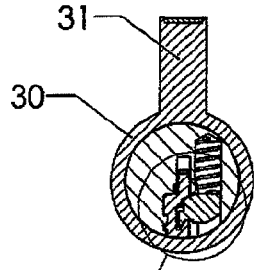
Figure 4B:
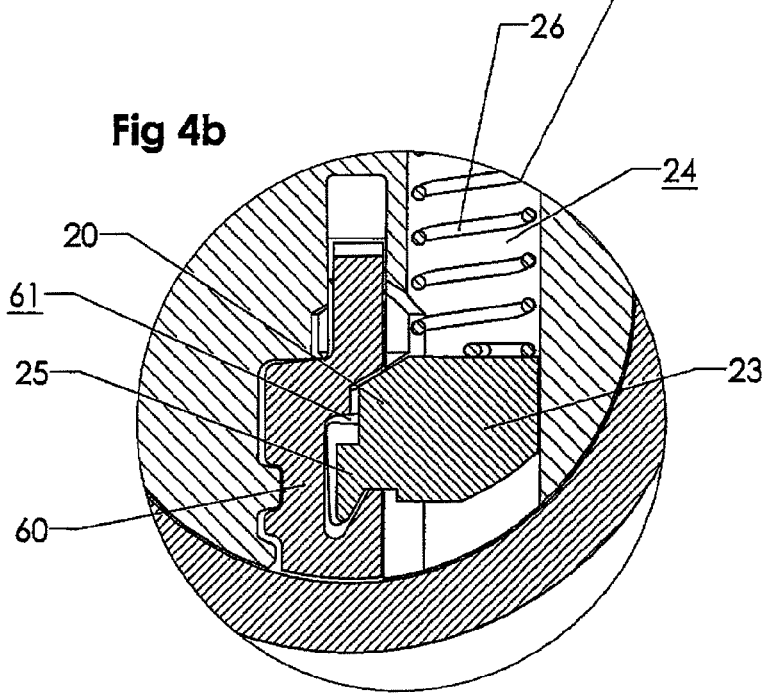
Figure 5A:
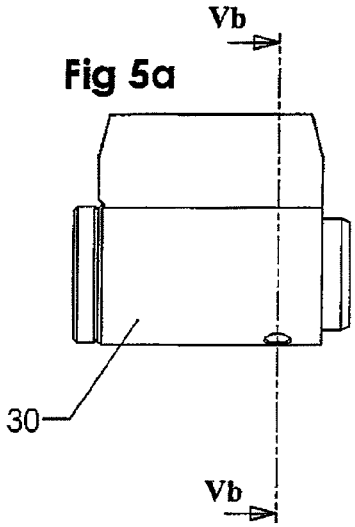
Figure 5B:
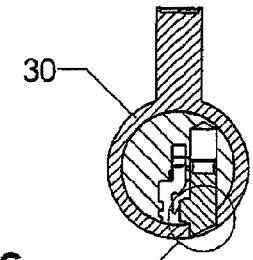
Figure 5C:
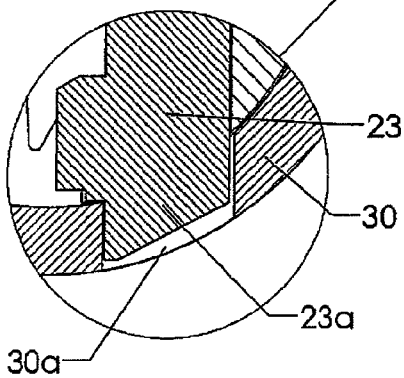

As appears from FIGS. 1*d*, 1*e* and 3, the outer portion 62 of the profile groove 61, and the corresponding base portion 52 of the profile rib 50 has a slanted upper wall 69 and slanted surface 59, respectively.

Now, since the sectional profile of the key blade 60 corresponds to the cross-sectional profile of the keyway 34, the key blade 60 can be inserted partially or fully into the keyway, as is known in the art. Of course, only key blades being cut with the particular profile of the keyway may be fully inserted into the keyway.

In order to allow for further variations of the exact profile of the keyway, there is provided, according to the present invention, a blocking element 20 (as mentioned above) which can) be regarded an a movable profile portion.

Generally, the blocking element has a profile section, which corresponds to the longitudinally extending groove 61 in the key blade. However, in the region of the outer portion 62 of the groove 61, it is somewhat larger, in a direction parallel to the central plane A. So, it does not fit into the profile groove of the keyway along the full length thereof.

However, locally, the key blade 60 is provided with a recess 70 which is wide enough to accommodate the uppermost portion of the blocking element 20, as will be explained more fully below.

In order to secure a well-defined mobility of the blocking element 20, it is integrated with or firmly connected to a body 23, which is guided for elevational movement in parallel to the central plane A of the key way in a substantially cylindrical cavity 24 at the side of the keyway, in parallel to the central plane A. Thus, the body 23 is guided for movement up and down in the cylindrical cavity 24, so that the integrated or connected blocking element 20 is also movable up and down.

The blocking element 20 may protrude partially or fully into the profile groove 61, in a cut-out portion of the profile rib 51.

In the embodiment illustrated in FIGS. 2, 3, 4*a*, 4*b*, the cross-sectional area of the blocking element 20, in the portion protruding into the groove, corresponds essentially to the contour of the profile rib 51, with an outermost part having a downwardly directed tongue 25. The rest of the blocking element has exactly the same configuration as the previous embodiment (FIG. 1*d*).

In FIGS. 5*a*, 5*b*, 5*c*, 6*a*, 6*b*, 6*c*, the blocking 20 element is integrated with or connected to a guiding body which also serves as a locking element serving also to lock the key plug against rotation in the cylindrical bore 32. For this purpose, the body 23 is extended downwardly so as to project with an end portion 23*a* past the circumferential surface of the key plug into a corresponding hole 30*a* in the housing. This is the position taken by the body and the blocking element in the initial position without any key blade being inserted into the keyway. The key plug 33 is effectively locked against rotation by means of the upper and lower locking pins 1, 2 as well as the downwardly projecting body 23 with its end portion 23*a* entering the hole 30*a*.

Figure 6A:
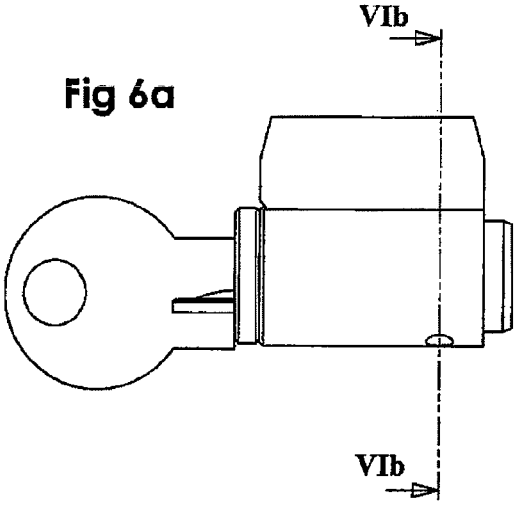
Figure 6B:
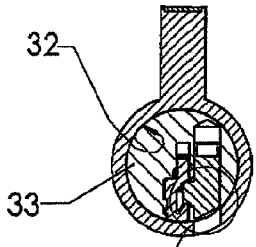
Figure 6C:
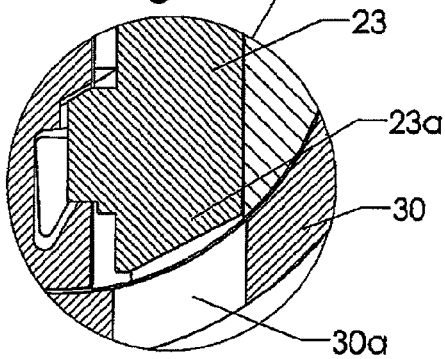
Figure 7A:
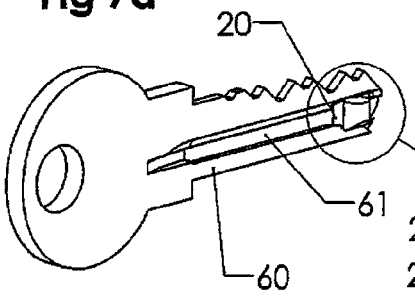
Figure 7B:
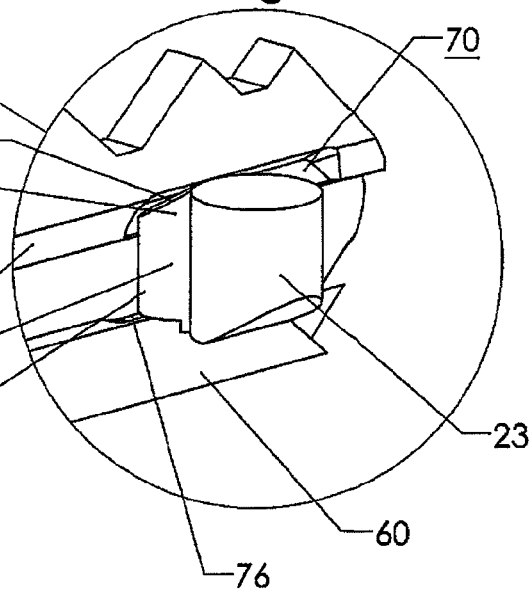

FIGS. 6*a*, 6*b*, 6*c* show the situation where a key blade has been inserted into the key way. Then, the blocking element 20 is lifted upwards, so that the end portion 23*a* of the body 23 also leaves the corresponding hole 30*a*. Of course, in this position, the key plug 33 is free to rotate in the cylindrical bore 32.

The elevational movement of the blocking element 20 is caused by a direct mechanical contact with the key blade, when the latter is inserted into the keyway.

The interaction between the blocking element and the key blade is illustrated in FIGS. 7*a*, 7*b*, 8*a*, 8*b*, 9*a*, 9*b*. Initially, when the keyway is empty, the blocking element 20 will be positioned in its lowermost position, because of the action of a compression spring 26 in the cavity 24 (FIG. 1*d*). In the embodiment of FIGS. 7*a*, 7*b*, 8*a*, 8*b*, the profile groove 61 of the key blade 60 has no undercut portion, but this will not make any difference to the interaction between the key blade and the blocking element 20.

When the key blade 60 is inserted into the keyway, a lower, first portion 21 of the blocking element 20 will make contact with a ramp surface 75 near the tip end of the key blade. By way of this contact, the blocking element 20 will move upwards and take the position shown in FIG. 7*b* and FIG. 1*d*. Here, the upper, second portion 22 of the blocking element 20 will be accommodated in the above-mentioned recess 70, which is locally cut out in this particular part of the keyway, so the width of the profile groove is effectively widened in this region.

Without such a recess 70, the blocking element would be jammed between the ramp surface 75 and the upper, slanted wall 69 of the longitudinal profile groove.

As seen from the end of the key way, the major part of the blocking element 20 will be concealed in a cut-out portion of the profile rib 51. In the initial, lowermost position, only the first, projecting portion 21 will be visible from the outside (see FIG. 1*e*), whereas in the elevated position shown in FIGS. 7*b*, 9*b*, only the second projecting portion 22 will extend upwardly above the longitudinal profile rib 51 (see FIG. 1*d*). Importantly, this second, elevated position will only be taken by the blocking element 20 upon insertion of the key blade, so this portion 22 will never be visible from the outside of the keyway (looking into the keyway when the latter is free).

Also importantly, the lower projecting portion 21 of the blocking element 20 is non-symmetrical in shape in relation to the upper or second projection portion 22. In the illustrated embodiments, the second projecting portion 22 has an upper, slanted surface portion 22*a* (FIG. 7*b*, 9*b*) which faces obliquely away from the associated side wall 50*d* of the keyway.

In this way, in case the configuration of the lower or first projecting portion 21 is observed from the outside, there is no way of determining the exact configuration or shape of the upper or second projecting portion 22. Accordingly, on the basis of merely inspecting the keyway from the outside, it will be difficult to make a key with a recess conforming to the shape of the upper or second projecting portion 22 of the blocking element.

In the embodiment shown in FIGS. 7*a*, 7*b*, 9*a*, 9*b* the blocking element 20 is located deep inside the keyway near the tip end of the key blade upon full insertion of the key blade into the keyway. The first or lower projecting portion 21 of the blocking element 20 contacts a machined, slightly recessed surface 76 (FIG. 8*b*) adjacent to the lower side wall of the profile groove (in this embodiment there is no undercut portion), whereas the upper or second projecting portion 22 of the blocking element 20 is accommodated in the local recess 70. This recess 70 is confined to the region of the fully inserted key blade in the vicinity of the locking element 20.

Figure 12:
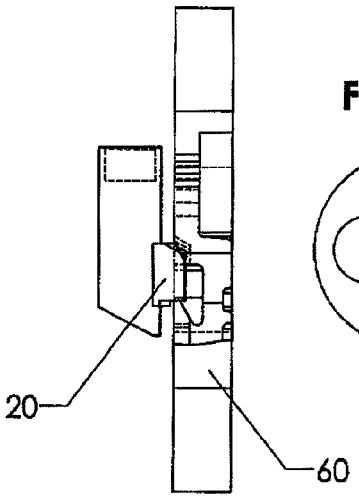
FIGS. 11 and 12 show the blocking element and the key blade of FIG. 10 in a cross-sectional view and an end view, respectively.
Figure 10:
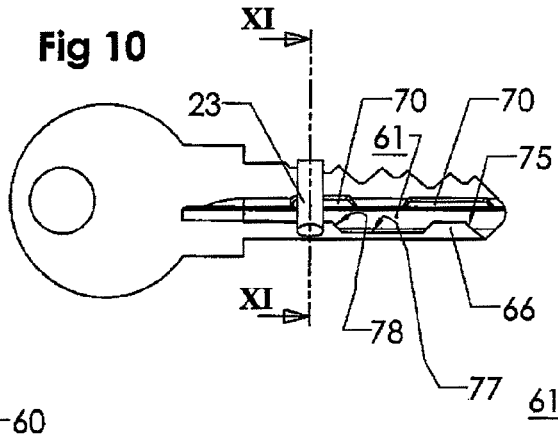
FIG. 10 shows, in a aide view, a key blade and e blocking element located closer to the entrance of the keyway.
Figure 11:
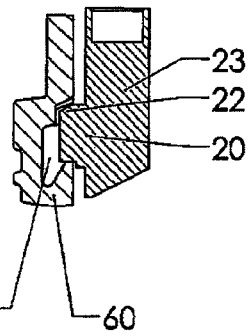

In FIGS. 10, 11, 12, the blocking element 20 is located closer to the entrance of the keyway, so when the key blade is fully inserted into the keyway, the blocking element 20 is far away from the tip end of key blade. In order to accommodate the whole cross-section of the blocking element 20, the lower part of the key blade material next to the groove 61 is taken away. Thus, the ridge portion 66 is cut away from the tip end of the key blade up to the location of the blocking element, leaving a lower side wall 77, except for a portion near the tip end of the key blade. In this case, of course, the local upper recess, accommodating the second or upper projecting portion 22 of the blocking element 20 is located so as to start, with some overlap, where the lower side wall 77 and an adjoining inclined or ramp surface 78 ends. The overlap length should correspond or slightly exceed the dimension of the blocking element 20 in the longitudinal direction of the key plug.

The upper, slanted wall portion of the recess 70 has an angle corresponding to the second projecting portion 22 of the blocking element 20.

Figure 8A:
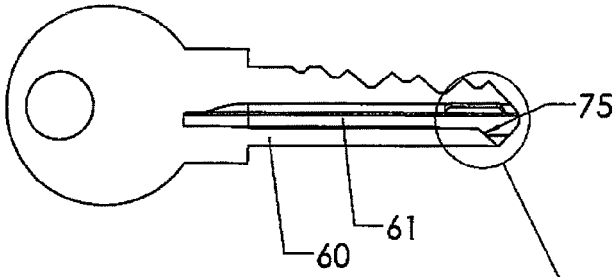
Figure 8B:
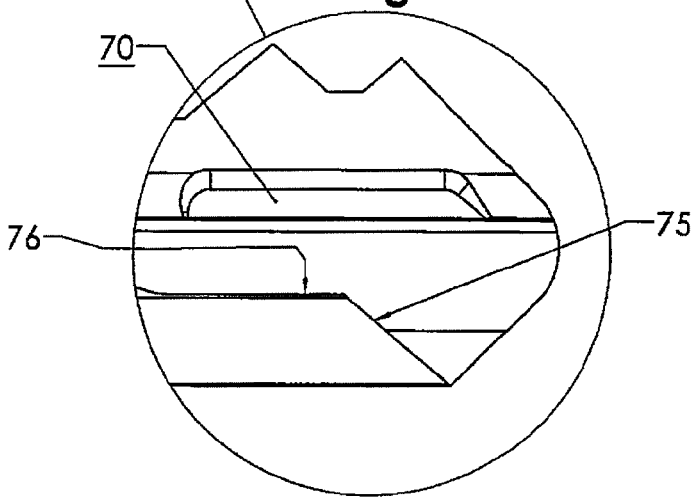
Figure 9A:
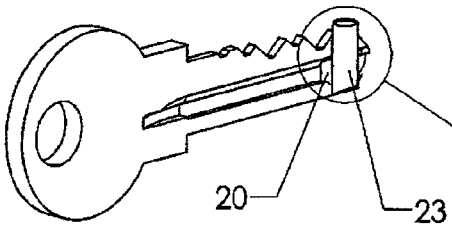
Figure 9B:
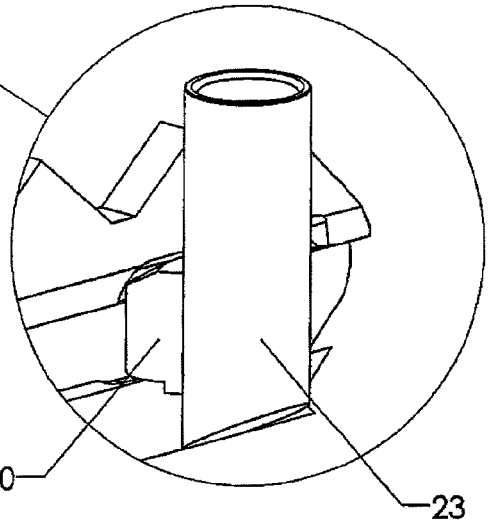

As will be seen from FIG. 10, the key blade is provided with a second local recess 70 near the tip end, just like the key blade shown in FIGS. 8*a* and 8*b*. Therefore, the key blade of FIG. 10 will cooperate also with a blocking element 20 arranged deep inside the keyway, like the ones shown in FIG. 7*b* and 9*b*.

Accordingly, by having two or more blocking elements distributed longitudinally along the keyway, it is possible to provide a hierarchic system with master keys that open all individual locks having blocking pins at various locations.

The invention claimed is:

1. A cylinder lock and key combination, wherein said cylinder lock comprises:

a housing having a cylindrical bore, a cylindrical key plug being rotatably journalled in said cylindrical bore, said key plug having a longitudinal, profiled keyway and means for locking the key plug against rotation in the cylindrical bore unless a correctly cut key blade is fully inserted into the keyway, said keyway being oriented along a central plane and having a profiled cross-section being partly defined by a profile rib extending longitudinally along said key plug and having a predetermined cross-sectional contour along at least a part of its length, and wherein said key comprises a correctly cut key blade having:

a cross-sectional profile fitting into said keyway, and a profile groove formed by a lower side wall and an upper side wall and extending longitudinally along the correctly cut key blade, said profile groove having a cross-sectional profile configured to accommodate said profile rib of the keyway when the correctly cut key blade is being inserted into the lock, wherein:

said lock comprises a blocking mechanism with at least one blocking element reaching into said keyway in the vicinity of said profile rib, said profile rib being provided with at least one longitudinally confined cut-out portion accommodating said at least one blocking element and said at least one blocking element forming a movable portion of said profile rib, said at least one blocking element is movable from a first blocking position, in which a first projecting portion of a cross-sectional profile of the at least one blocking element extends outside and below the cross-sectional contour of said profile rib, into a second blocking position, in which a different, second projecting portion of said at least one blocking element extends outside and above the cross-sectional contour of said profile rib and is accommodated by at least one local recess formed in the upper side wall of the profile groove of the correctly cut key blade, one of said first projecting portion and said second projecting portion of the at least one blocking element always extending outside the contour of the profile rib, seen in a vertical direction, the insertion of the correctly cut key blade causes the movement of said at least one blocking element from said first blocking position into said second blocking position, said first and second projecting portions of said at least one blocking element are non-symmetrical in shape;

wherein a vertical dimension of an outer portion of said profile groove between said lower side wall and said upper side wall is smaller than a vertical dimension of said at least one blocking element except at said at least one local recess where a vertical dimension of said outer portion is larger than the vertical dimension of said at least one blocking element, said vertical dimension of said outer portion at said at least one local recess extending between non-symmetrical and non-parallel upper and lower side walls thereof;

said upper and lower side walls of said outer portion at said at least one local recess being adapted in shape so as to accommodate said non-symmetrical first and second projecting portions of said at least one blocking element; and said profile groove, with its at least one local recess, being configured to enable said at least one blocking element to perform an elevational movement to said second blocking position so as to be accommodated in said at least one local recess, when the correctly cut key blade is being inserted into said key way of the key plug but blocks the full insertion of any other key blade not being provided with said at least one local recess.

2. The cylinder lock and key combination as defined in claim 1, wherein said first projecting portion of said at least one blocking element is adapted to be contacted by said correctly cut key blade, when the correctly cut key blade is inserted into said keyway, so as to bring about said movement from said first blocking position into said second blocking position.

3. The cylinder lock and key combination as defined in claim 1, wherein said at least one blocking element, apart from said second projecting portion, has a cross-section corresponding substantially to only a part of the cross-sectional area of said profile rib.

4. The cylinder lock and key combination as defined in claim 3, wherein the cross-section of said at least one blocking element, apart from said second projecting portion, corresponds substantially to the cross-sectional area of a base part of said profile rib.

5. The cylinder lock and key combination as defined in claim 1, wherein a cross-section of said at least one blocking element, apart from said second projecting portion, corresponds substantially to the entire cross-sectional contour of said profile rib.

6. The cylinder lock and key combination as defined in claim 1, wherein said at least one blocking element extends through a side opening in a side wall of said keyway from a body being movably guided in a side cavity in said key plug, said body and said at least one blocking element forming at least one part of said blocking mechanism.

7. The cylinder lock and key combination as defined in claim 6, wherein said body is substantially cylindrical and said side cavity is also substantially cylindrical.

8. The cylinder lock and key combination as defined in claim 6, wherein said body has a length along a cylindrical axis which is longer than the extension of said at least one blocking element, measured in parallel to said cylindrical axis.

9. The cylinder lock and key combination as defined in claim 8, wherein said substantially cylindrical cavity extends in parallel to said central plane of the keyway.

10. The cylinder lock and key combination as defined in claim 6, wherein said body is biased by a compression spring, thereby urging the at least one blocking element to move in a corresponding direction.

11. The cylinder lock and key combination as defined in claim 6, wherein said body also cooperates with said means for locking said key plug against rotation.

12. The cylinder lock and key combination as defined in claim 11, wherein said side cavity extends to a circumferential surface of said key plug, and said body has an end portion which will extend past said circumferential surface into a corresponding hole in said housing, in a normal, locking position, in which said body will lock the key plug against rotation, except upon insertion of said correctly cut key blade fully into said keyway.

13. The cylinder lock and key combination as defined in claim 1, wherein said means for locking the key plug against rotation comprise upper and lower locking pins which are movably guided in holes located in said key plug, above said keyway, and in said housing, respectively.

14. The cylinder lock and key combination as defined in claim 1, wherein said profile rib has a downwardly projecting tongue extending from a base part of the profile rib.

15. The cylinder lock and key combination as defined in claim 1, wherein said second projecting portion has an upper, slanted surface portion facing obliquely away from an associated side wall of the key way.

16. The cylinder lock and key combination as defined in claim 15, wherein said profile rib has a base portion with an upper, inclined surface portion facing obliquely away from the associated side wall of the key way and concealing said second projecting portion of the at least one blocking element, when the at least one blocking element is located in said first, blocking position.

17. The cylinder lock and key combination as defined in claim 16, wherein said slanted surface portion of said second projecting portion has an inclinational angle relative to a plane perpendicular to said associated side wall of the keyway, said inclinational angle being at least as large as the inclinational angle of said inclined surface portion of said base portion of said profile rib.

18. A cylinder lock and key combination, wherein said cylinder lock comprises:

a housing having a cylindrical bore, a cylindrical key plug being rotatably journalled in said cylindrical bore, said key plug having a longitudinal, profiled keyway and means for locking the key plug against rotation in the cylindrical bore unless a correctly cut key blade is fully inserted into the keyway, said keyway being oriented along a central plane and having a profiled cross-section being partly defined by a profile rib extending longitudinally along said key plug and having a predetermined cross-sectional contour along at least a part of its length, and wherein said key comprises a correctly cut key blade having:

a cross-sectional profile fitting into said keyway, and a profile groove formed by a lower side wall and an upper side wall and extending longitudinally along the correctly cut key blade, said profile groove having a cross-sectional profile configured to accommodate said profile rib of the keyway when the correctly cut key blade is being inserted into the lock, wherein:

said lock comprises a blocking mechanism with at least one blocking element reaching into said keyway in the vicinity of said profile rib, said at least one blocking element is movable from a first blocking position, in which a first projecting portion of a cross-sectional profile of the at least one blocking element extends outside and below the cross-sectional contour of said profile rib, into a second blocking position, in which a different, second projecting portion of said at least one blocking element extends outside and above the cross-sectional contour of said profile rib and is accommodated by a corresponding local recess of at least two local recesses formed in said upper side wall of said profile groove, one of said first projecting portion and said second projecting portion of the at least one blocking element always extending outside the contour of the profile rib, seen in a vertical direction, the insertion of the correctly cut key blade causes the movement of said at least one blocking element from said first blocking position into said second blocking position, and said first and second projecting portions of said at least one blocking element are non-symmetrical in shape;

wherein a vertical dimension of an outer portion of said profile groove between said lower side wall and said upper side wall is smaller than a vertical dimension of said at least one blocking element except at said at least two local recesses where a vertical dimension of said outer portion is larger than the vertical dimension of said at least one blocking element, said vertical dimension of said outer portion at said at least two local recesses extending between said-non-symmetrical and non-parallel upper and lower side walls thereof;

said upper and lower side walls of said outer portion at said at least two local recesses being adapted in shape so as to accommodate said non-symmetrical first and second projecting portions of said at least one blocking element; and said profile groove, with said at least two local recesses, being configured to enable said at least one blocking element to perform an elevational movement to said second blocking position so as to be accommodated in a corresponding local recess of said at least two local recesses, when the correctly cut key blade is being inserted into said keyway of the key plug but blocks the full insertion of any other key blade not being provided with said at least two local recesses.

19. The cylinder lock and key combination as defined in claim 1, and further including a second local recess forming at least two local recesses in said upper side wall of the profile groove, said second local recess being displaced a predetermined distance along the correctly cut key blade relative to a first local recess of said at least two local recesses with a longitudinally adjoining opposite recess formed at a lower portion of the correctly cut key blade, said longitudinally adjoining opposite recess being located between the first local recess and the second local recess.

20. The cylinder lock and key combination as defined in claim 19, wherein said profile groove extending longitudinally along the correctly cut key blade is provided with a ramp surface leading from a bottom edge of the correctly cut key blade to the lower side wall of the profile groove.

* * * * *

UNITED STATES PATENT AND TRADEMARK OFFICE

CERTIFICATE OF CORRECTION

PATENT NO. : 8,230,708 B2
APPLICATION NO. : 12/388069
DATED : July 31, 2012
INVENTOR(S) : Bo Widén It is certified that error appears in the above-identified patent and that said Letters Patent is hereby corrected as shown below:

ON THE TITLE PAGE:

At item (75), Inventor, change "Bo Widén, Torshilla (SE)" to --Bo Widén, Torshälla (SE)--.

Signed and Sealed this
Thirteenth Day of November, 2012

David J. Kappos

David J. Kappos
*Director of the United States Patent and Trademark Office*